United States Patent [19]

Aoki

[11] 4,095,501

[45] Jun. 20, 1978

[54] AUTOMATIC RHYTHM PERFORMING APPARATUS HAVING A VOLTAGE-CONTROLLED VARIABLE FREQUENCY OSCILLATOR

[75] Inventor: Eiichiro Aoki, 624, Hamamatsu, Japan

[73] Assignee: Nippon Gakki Seizo Kabushiki Kaisha, Japan

[21] Appl. No.: 744,770

[22] Filed: Nov. 24, 1976

[30] Foreign Application Priority Data

Nov. 29, 1975 Japan ..... 50-142547

[51] Int. Cl.[2] ..... G10H 1/00

[52] U.S. Cl. ..... 84/1.03; 84/1.24

[58] Field of Search ..... 84/1.01, 1.03, 1.24

[56] References Cited

U.S. PATENT DOCUMENTS

| | | | |
|---|---|---|---|
| 3,585,891 | 6/1971 | Schwartz | 84/1.03 |
| 3,760,088 | 9/1973 | Nakada | 84/1.03 |
| 3,789,718 | 2/1974 | Bunger | 84/1.01 |
| 3,803,970 | 4/1974 | Hirano | 84/1.03 |
| 3,813,472 | 5/1974 | Hirano | 84/1.03 |
| 3,943,813 | 3/1976 | Teshima et al. | 84/1.03 |

*Primary Examiner*—Gene Z. Rubinson
*Assistant Examiner*—Vit W. Miska
*Attorney, Agent, or Firm*—Flynn & Frishauf

[57] ABSTRACT

An automatic rhythm performing apparatus comprises a voltage-controlled variable frequency clock generator, a plurality of tempo determining voltage signal sources, a selector for selectively coupling one of the tempo determining voltage signal sources to the clock generator, and an automatic rhythm generating circuit including a counter for counting clock pulses from the clock generator and generating a rhythm in response to the clock signal. The tempo of the rhythm produced by the rhythm generating circuit is dependent upon the magnitude of a tempo determining voltage coupled to the clock generator. A control circuit having a foot switch and a rhythm start switch may be provided to control the selector and counter. The counter is enabled to count the clock pulses by the operation of the rhythm start switch. The operation of the foot switch causes the counter to be disabled or causes the tempo determining voltage source coupled to the clock generator to be switched from one source to another.

7 Claims, 2 Drawing Figures

AUTOMATIC RHYTHM PERFORMING APPARATUS HAVING A VOLTAGE-CONTROLLED VARIABLE FREQUENCY OSCILLATOR

BACKGROUND OF THE INVENTION

This invention relates to an automatic rhythm performing apparatus.

A rhythm performance is usually effected in company with the performance of a musical instrument and an automatic rhythm performance apparatus is often built in an electronic musical instrument. With such an automatic rhythm performing apparatus a rhythm selection is effected by rhythm selection switches on a front panel of the electronic musical instrument and a rhythm tempo is set by a slider of an oscillation frequency control potentiometer connected to a variable frequency clock generator, the slider being operable on the front panel of the electronic musical instrument.

During the performance of an electronic musical instrument it is difficult for a player to change a rhythm tempo by adjusting the slider of the potentiometer. It is particularly difficult to provide ritardando (gradual slackening in tempo) and accelerando (gradual increase in tempo) effects.

SUMMARY OF THE INVENTION

It is an object of this invention to provide an automatic rhythm performing apparatus provided with rhythm tempo varying means which permits a rhythm tempo to be varied easily by a player during the performance of a musical instrument.

It is another object of this invention to provide an automatic rhythm performing apparatus provided with a means for gradually varying a rhythm tempo.

An automatic rhythm performing apparatus according to this invention comprises voltage controlled variable frequency oscillator means having an input and an output and responsive to a tempo determining voltage signal at the input to generate at the output a clock signal of a frequency corresponding to a voltage value of the tempo determining input voltage signal, a plurality of tempo determining voltage signal sources and selection means for selectively coupling one of the tempo determining voltage signal sources to the input of the voltage controlled oscillator means.

The output clock signal of the voltage-controlled oscillator means is coupled to a known automatic rhythm performance signal generating means having a counter for counting clock signals.

The selection means may have a manually operable switch and a switch operation by a player selectively couples one of tempo determining signals of different voltages which has been preset to a voltage-controlled oscillator to permit a rhythm tempo to be varied even during the performance of the musical instrument. A time constant circuit may be inserted between the selection means and the voltage-controlled oscillator to provide a gradually varying rhythm tempo.

In a preferred embodiment of this invention a control circuit means including a self-return type foot switch and a rhythm start switch is used to facilitate variation of the rhythm tempo. The control circuit means delivers a reset signal to the reset input of the counter in the rhythm signal generating circuit means in response to the normal state of the rhythm start switch to disable the count of clock signals, causes the counter enable the count of clock signals in response to the operation of the rhythm start switch, and causes the selection means to switch one of the tempo determining voltage signal sources to be coupled to the voltage-controlled oscillator means from one source to another source or disable the counter in response to the operation of the foot switch.

DETAILED DESCRIPTION OF THE PREFERRED EMBODIMENTS

Figure 1:
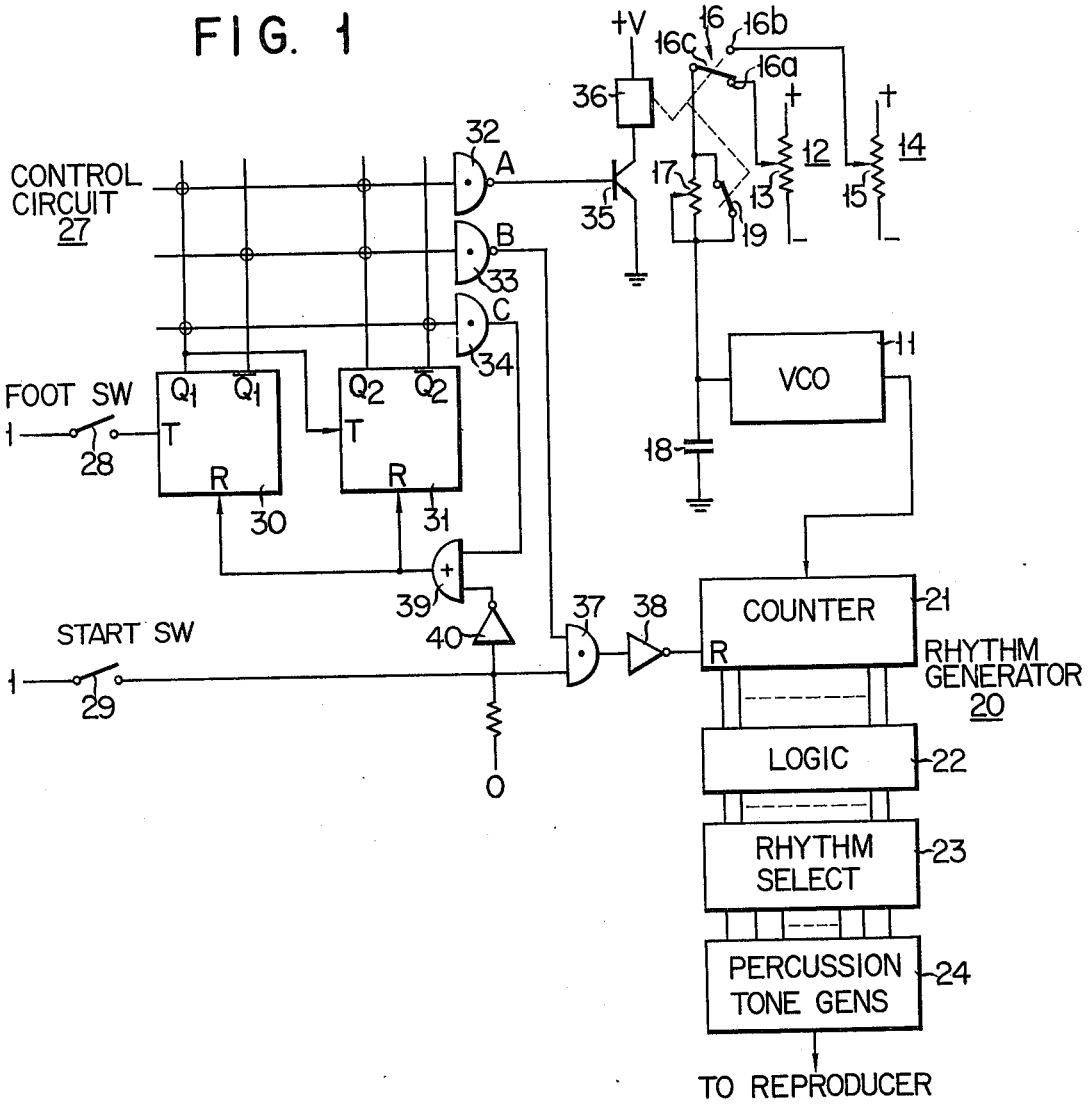
FIG. 1 shows an automatic rhythm performing apparatus according to one embodiment of this invention.

In FIG. 1 reference numeral 11 is a voltage-controlled variable frequency oscillator (hereinafter referred to as VCO) responsive to a tempo determining voltage signal at the input to generate at the output a clock signal of a frequency corresponding to the voltage value of the tempo determining voltage signal.

One of a plurality of tempo determining voltage signal sources 12 and 14 is selectively coupled by a selection means, for example, a single-pole double-throw relay operated switch 16, to the input of VCO11. The voltage signal sources 12 and 14 has potentiometers 13 and 15, respectively connected across DC voltage source. Sliders of the potentiometers 12 and 14 are placed in the positions operable by a player and connected to fixed contacts 16*a* and 16*b* of the switch 16, respectively. A movable contact 16*c* of the switch 16 is connected through a resistor 17, preferably a variable resistor as shown, to the input of VCO11 which is connected to ground through a capacitor 18. A relay operated switch 19 is connected in parallel with the resistor 17. The switches 16 and 19 may be electronic switches.

The output of VCO11 is coupled to a counter 21 having a reset input R in a rhythm signal generator 20. The rhythm generator 20 has, as well known in the art, together with the counter 21 for counting clock pulses from VCO11, a logic circuit 22 connected to the outputs of the counter 21 for producing rhythm pattern signals, a manually operable rhythm selection means coupled to the outputs of the logic circuit 22 for selecting desired rhythm pattern signals, and percussion tone generators 24. The output of the rhythm signal generator 20 is coupled to a reproducing means including an amplifier and loudspeaker not shown.

The counter 21 is reset by a reset signal of a logical "1" level at the reset input R to cause the counting of clock signals to be disabled and, when the reset signal disappears, counts the clock signals from an initial value.

A control circuit 27 is provided to control the above-mentioned switches 16 and 19 and counter 21. The control circuit 27 has a foot switch 28 and a rhythm start switch 29. The foot switch 28 and rhythm start switch 29 are both of a normally open type and the foot switch 28 is of a self-return type. The control circuit 27 includes a first trigger flip-flop circuit 30 having complementary outputs $Q_1$ and $\overline{Q}_1$ and a second trigger flip-flop circuit 31 having complementary outputs $Q_2$ and $\overline{Q}_2$. The output $Q_1$ of the flip-flop circuit 30 and output $Q_2$ of the flip-flop circuit 31 are connected to a NAND gate 32; the output $\overline{Q}_1$ of the flip-flop circuit 30 and output $Q_2$ of the flip-flop circuit 31, to a NAND gate 33; and the output $Q_1$ of the flip-flop circuit 30 and output $\overline{Q}_2$ of the flip-flop circuit 31, to an AND gate 34.

The output A of the NAND gate 32 is coupled to the base of a transistor 35 whose collector is coupled to a relay coil 36. The output B of the NAND gate 33 is coupled to one input of an AND gate 37 to the other input of which a logical "1" level signal is coupled when the rhythm start switch 29 is rendered ON. A logical "0" level signal is normally coupled to the other input of the AND gate 37. The output of the AND gate 37 is coupled to the input of an inverter 38 the output of which is coupled to the reset input R of the counter 21. The output of the AND gate 34 is coupled to one input of an OR gate 39 the output of which is coupled to the reset inputs R of the first and second flip-flop circuits 30 and 31. The output of an inverter 40 is connected to the other input of the OR gate 39. The inverter 40 is coupled to normally receive a logical "0" level signal and receive a logical "1" level signal when the rhythm start switch 29 is rendered ON. A logical "1" level signal is coupled to the trigger input T of the first flip-flop circuit 30 when the foot switch 28 is operated and the output $Q_1$ of the first flip-flop circuit 30 is coupled to the trigger input T of the second flip-flop circuit 31.

The first flip-flop circuit 30, when reset by a logical "1" level reset signal, makes the output $Q_1$ a logical "0" level and the output $\overline{Q}_1$ a logical "1" level and the second flip-flop circuit 31, when reset by a logical "1" level reset signal, makes the output $Q_2$ a logical "0" level and the output $\overline{Q}_2$ a logical "1" level. The first flip-flop circuit 30 is triggered by a logical "1" level signal, which is applied to the trigger input T by the operation of the foot switch 28, to invert the output states. The second flip-flop circuit 31 is triggered when the output $Q_1$ of the first flip-flop circuit 30 is varied from the logical "0" level to the logical "1" level to invert the output states.

Table shows the states of outputs $Q_1$, $\overline{Q}_1$, $Q_2$ and $\overline{Q}_2$ of the flip-flop circuits 30 and 31 and the output states of outputs A, B and C of the gates 32, 33 and 34. In Table, I is an initial state when the first and second flip-flop circuits 30 and 31 are both reset; II, III and IV are the states when the foot switch 28 is operated the first time, second time and third time, respectively.

Table

| | $Q_1$ | $\overline{Q}_1$ | $Q_2$ | $\overline{Q}_2$ | A | B | C |
|---|---|---|---|---|---|---|---|
| I | 0 | 1 | 0 | 1 | 1 | 1 | 0 |
| II | 1 | 0 | 1 | 0 | 0 | 1 | 0 |
| III | 0 | 1 | 1 | 0 | 1 | 0 | 0 |
| IV | 1 | 0 | 0 | 1 | 1 | 1 | 1 |

Figure 2:
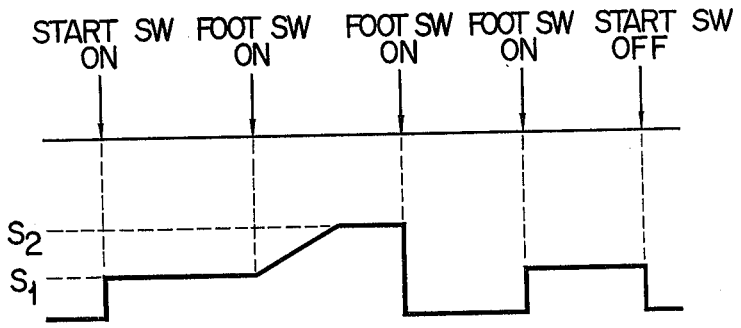
FIG. 2 is a diagram useful in explaining the operation of the automatic rhythm performance apparatus in accordance with this invention.

The operation of an automatic rhythm performing apparatus will now be explained by referring to FIG. 2.

When as shown in FIG. 1 the rhythm start switch 29 is OFF, a logical "0" level signal is coupled to the AND gate 37 and inverter 40. As a result, the output of the AND gate 37 becomes a logical "0" level and the output of the inverter 40 becomes a logical "1" level. The counter 21 is reset by a logical "1" level reset signal and the first and second flip-flop circuits 30 and 31 are reset by a logical "1" level reset signal from the OR circuit 39. The output states of the first and second flip-flop circuits 30 and 31 and of the gates 32 to 34 at this time are shown in the raw of I in Table.

In this state, the output A of the NAND gate 32 is at a logical "1" level. In consequence, the transistor 35 is rendered conductive to cause the relay coil 36 to be energized. By energization of the relay coil 36 the movable contact **16*c* of the switch 16 is brought into contact with the fixed contact 16*a* and the switch 19 is closed. The first tempo determining voltage signal source 12 is coupled to VCO11. Since, however, the counter 21 is reset by a logical "1" level signal from the inverter 38**, no rhythm performance is effected.

When the rhythm start switch 29 is closed, the AND gate 37 generates a logical "1" level output, since the output B of the NAND gate 33 is at a logical "1" level. As a result, the reset input of the counter 21 becomes a logical "0" level by means of the inverter 38 to permit the reset state of the counter to be released. At this time, VCO11 oscillates at a frequency dependent upon the voltage value of a first tempo determining voltage signal from the first source 12 which is charged in the storage capacitor 18 and thus the rhythm generator 20 generates a rhythm at a tempo $S_1$ dependent upon the oscillation frequency of VCO11 as shown in FIG. 2.

Upon operating the foot switch 28 the first and second flip-flop circuits 30 and 31 are both triggered to change output states as shown in the raw of II in Table. At this time only the output A of the NAND gate 32 is varied from a logical "1" level to a logical "0" level. In consequence, the transistor 35 is rendered nonconductive to open the switch 19 and to switch the movable contact **16*c* of the switch 16 from the fixed contact 16*a* to the fixed contact 16*b***.

As a result, the second tempo determining signal source 14 is coupled through the resistor 17 to VCO11. Suppose that the tempo determining voltage signal of the second source 14 is greater than that of the first source 12 and $S_2$ represents a tempo which is dependent upon the tempo determining voltage signal of the second source 14. Then, the rhythm tempo is gradually varied from $S_1$ to $S_2$ dependent upon a time constant of a time constant circuit consisting of the resistor 17 and capacitor 18.

When the foot switch 28 is next operated, only the first flip-flop circuit 30 is triggered to cause the output states to be inverted. The second flip-flop circuit 31 is not triggered since the output $Q_1$ of the flip-flop circuit 30 is varied from the logical "1" level to a logical "0" level. In this state, the output A of the NAND gate 32 is varied from the logical "0" level to a logical "1" level and the output B of the NAND gate 33 is varied from the logical "1" level to a logical "0" level as shown in the raw of III in Table. As a result, the transistor 35 is again rendered conductive to cause the switches 16 and 19 to be switched and thus the first tempo determining voltage signal source 12 is coupled to VCO11. Since, however, the output B of the NAND gate 33 is at a logical "0" level, the output of the AND gate 37 is at a logical "0" level and the output of the inverter 38 is at a logical "1" level. As a result, the counter 21 is reset. In this state no rhythm is produced as shown in FIG. 2.

When the foot switch 28 is next operated, the outputs of the flip-flop circuits 30 and 31 and of the gates 32 to 34 are varied as indicated in the raw of IV in Table. Since in this state the output C of the AND gate 34 becomes a logical "1" level, the flip-flop circuits 30 and 31 are reset to cause the output states to be returned to the initial state as indicated by the raw of I in Table. As shown in FIG. 2 a rhythm performance is restarted at the tempo S1. By opening the start switch 29 the rhythm performance is finally stopped.

Although the above-mentioned embodiment employs the two tempo determining voltage signal sources, this invention is not restricted thereto. More tempo determining voltage signal sources can be employed using logic circuit means.

What is claimed is:

1. An automatic rhythm performing apparatus having a presettable rhythm tempo, comprising:

a plurality of tempo determining voltage signal sources;

voltage-controlled variable frequency oscillator means having an input and an output and responsive to a tempo determining voltage signal at the input to generate at the output a clock signal having a frequency which is a function of the voltage value of the tempo determining voltage signal at the input;

selecting means coupled to said tempo determining voltage signal sources for selectively coupling one of the plurality of tempo determining voltage signal sources to the input of said voltage-controlled oscillator means to thereby preset the rhythm tempo; and rhythm signal generating circuit means coupled to said voltage-controlled variable frequency oscillator means and responsive to the clock signal to generate a rhythm signal having a tempo corresponding to the frequency of the clock signal.

2. An automatic rhythm performing apparatus according to claim 1 in which said rhythm signal generating circuit means includes a counter means having a reset input and coupled to said voltage-controlled oscillator means, said counter means being adapted to disable the count of a clock signal in response to the presence of a reset signal at the reset input thereof and to enable the count of a clock signal in response to the absence of the reset signal at the reset input thereof; and further comprising control circuit means coupled to said counter means and to said selecting means and having a first switch and a second switch of self-return type which self-return to a normal state, said control circuit means providing the reset signal to the reset input of said counter in response to the normal state of said first switch, enabling said counter means in response to the operation of said first switch, and causing said selecting means to switch said tempo determining voltage signal source coupled to said voltage-controlled oscillator means from one source to another source in response to the operation of said second switch.

3. An automatic rhythm performing apparatus according to claim 1, further including a resistor coupled between said selecting means and the input of said voltage-controlled oscillator means, and a capacitor coupled between the input of said voltage-controlled oscillator means and a reference potential point.

4. An automatic rhythm performing apparatus according to claim 3 in which said resistor is a variable resistor.

5. An automatic rhythm performing apparatus according to claim 3, further including a switch connected in parallel with said resistor.

6. An automatic rhythm performing apparatus according to claim 1 in which said tempo determining voltage signal sources each comprise an adjustably variable DC voltage source.

7. An automatic rhythm performing apparatus according to claim 6 in which said variable tempo determining voltage signal sources each comprise a DC voltage supply source and a potentiometer connected across said DC voltage supply source.

* * * * *